US010166781B2

(12) United States Patent
Schach

(10) Patent No.: US 10,166,781 B2
(45) Date of Patent: Jan. 1, 2019

(54) BOTTLING PLANT WITH AN INFORMATION-ADDING STATION CONFIGURED TO ADD INFORMATION ON THE OUTER SURFACE OF A BOTTLE OR CONTAINER

(75) Inventor: Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 1074 days.

(21) Appl. No.: 12/762,964

(22) Filed: Apr. 19, 2010

(65) Prior Publication Data

US 2010/0257819 A1 Oct. 14, 2010

Related U.S. Application Data

(63) Continuation-in-part of application No. PCT/EP2008/007043, filed on Aug. 28, 2008.

(30) Foreign Application Priority Data

Oct. 19, 2007 (DE) ..... 10 2007 050 490
Oct. 19, 2007 (DE) ..... 10 2007 050 493

(51) Int. Cl.
*B41F 17/18* (2006.01)
*B41F 17/22* (2006.01)
*B41J 3/407* (2006.01)

(52) U.S. Cl.
CPC ..... *B41J 3/4073* (2013.01)

(58) Field of Classification Search
CPC . B41N 2210/00; B41N 2210/06; B41F 17/18; B41F 17/22
USPC ..... 53/411, 131.2; 101/212, 213, 216, 221, 101/35, 36, 38.1, 39, 103, 379
See application file for complete search history.

(56) References Cited

U.S. PATENT DOCUMENTS 2,263,893 A * 11/1941 Schulman ..... 101/23
2,751,701 A * 6/1956 Grupe ..... B41F 17/006 101/296
3,294,889 A * 12/1966 Downie et al. ..... 264/255
(Continued)

FOREIGN PATENT DOCUMENTS

CN 1545448 A 11/2004
DE 102006001223 A1 7/2007
(Continued)

OTHER PUBLICATIONS

International Search Report PCT/EP2008/007043 and English translation thereof.

(Continued)

*Primary Examiner* — Gloria R Weeks
(74) *Attorney, Agent, or Firm* — Nils H. Ljungman & Associates

(57) ABSTRACT

Container printing arrangement for printing bottles or similar containers on an outer surface thereof. The container printing arrangement comprises one or more printing stations and a container conveyor. The printing station has a print head, a conveyor arrangement, and transfer elements which are moved by the conveyor arrangement. The transfer elements each comprise a first resilient layer and a second resilient layer which supports the first resilient layer. The first resilient layer has a transfer surface which receives a print image from the print head, and then transfers the print image onto a container.

19 Claims, 10 Drawing Sheets

(56) References Cited

U.S. PATENT DOCUMENTS 3,577,919 A * 5/1971 Usko ..... B65G 47/24 101/35
3,613,570 A * 10/1971 Gladen ..... B44B 5/028 101/31
3,665,851 A * 5/1972 Edwards et al. ..... 101/114
3,695,176 A * 10/1972 Van Der Roer ..... 101/39
3,718,531 A * 2/1973 Lewis ..... 428/172
3,741,117 A * 6/1973 Bienert et al. ..... 101/489
3,926,114 A * 12/1975 Matuschke ..... 101/142
3,961,575 A * 6/1976 Rodabaugh ..... B41F 17/14 101/31
4,013,496 A * 3/1977 Amberg ..... 156/85
4,041,864 A * 8/1977 Dahlgren et al. ..... 101/350.4
4,047,481 A * 9/1977 Saunders ..... 101/376
4,175,993 A * 11/1979 Robertson ..... B41F 17/22 101/40.1
4,195,566 A * 4/1980 Ozawa et al. ..... 101/38.1
4,205,596 A * 6/1980 Chesnut ..... 493/370
4,208,963 A * 6/1980 Dahlgren ..... 101/141
4,211,167 A * 7/1980 Corse ..... 101/148
4,373,442 A * 2/1983 Dahlgren et al. ..... 101/207
4,481,282 A * 11/1984 Obata ..... G03F 7/0752 101/456
4,519,310 A * 5/1985 Shimizu et al. ..... 101/35
4,527,471 A * 7/1985 Dahlgren et al. ..... 101/148
4,673,303 A * 6/1987 Sansone et al. ..... 347/103
4,704,964 A * 11/1987 Robertson ..... 101/425
4,723,485 A * 2/1988 Berberich et al. ..... 101/44
4,743,920 A * 5/1988 Tohma et al. ..... 347/171
4,928,588 A * 5/1990 Mathis ..... 101/9
4,981,547 A 1/1991 Zodrow et al.
5,110,402 A 5/1992 Zodrow et al.
5,193,456 A * 3/1993 Wolfe et al. ..... 101/40
5,207,153 A 5/1993 Thomason
5,311,816 A * 5/1994 Schliessmann ..... 101/488
5,355,794 A * 10/1994 Freudenheim ..... 101/129
5,427,023 A * 6/1995 Privin ..... 101/91
5,456,169 A * 10/1995 Rohwetter ..... B41F 17/16 101/126
5,459,979 A * 10/1995 Tommasi ..... B65B 63/026 100/26
5,645,888 A * 7/1997 Titterington et al. ..... 427/256
5,806,426 A * 9/1998 Choulet ..... 101/211
5,823,106 A * 10/1998 No et al. ..... 101/35
6,058,985 A 5/2000 Petri et al.
6,148,726 A * 11/2000 Harada ..... B41N 10/02 101/217
6,263,790 B1 * 7/2001 Wyssmann et al. ..... 101/35
6,276,266 B1 * 8/2001 Dietz et al. ..... 101/41
6,283,022 B1 * 9/2001 Kamen et al. ..... 101/129
6,374,734 B1 * 4/2002 Gaffney ..... B41F 27/00 101/217
6,382,102 B1 * 5/2002 Herrmann ..... B41N 10/04 101/217
6,439,368 B1 8/2002 Koertge
6,463,964 B2 10/2002 Clusserath
6,484,632 B2 * 11/2002 Hoffmann ..... B41N 6/00 101/216
6,490,969 B2 * 12/2002 Aichele ..... 101/37
6,504,559 B1 1/2003 Newton
6,666,937 B2 12/2003 Weder et al.
6,684,770 B2 2/2004 Kamen et al.
6,769,357 B1 8/2004 Finan
6,857,358 B2 * 2/2005 Dittrich et al. ..... 101/35
6,880,457 B2 * 4/2005 Roesch et al. ..... 101/38.1
6,907,823 B2 * 6/2005 Gelbart ..... 101/40.1
6,920,822 B2 7/2005 Finan
6,997,108 B2 * 2/2006 Tabuchi et al. ..... 101/217
7,011,728 B2 3/2006 Dewig
7,013,624 B2 * 3/2006 Zwilling ..... 53/544
7,032,514 B2 * 4/2006 Mori et al. ..... 101/463.1
7,210,408 B2 5/2007 Uptergrove
7,334,336 B2 * 2/2008 Tan et al. ..... 29/895.3
7,396,171 B2 * 7/2008 Gipson ..... 400/139
7,404,277 B2 7/2008 Schach et al.
7,443,592 B2 10/2008 Raymond et al.
7,905,174 B2 * 3/2011 Vetter et al. ..... 101/38.1
8,256,854 B2 9/2012 Till
8,365,658 B2 * 2/2013 Ouchi ..... 101/32
9,032,872 B2 * 5/2015 Uptergrove ..... B41J 3/4073 101/35
2003/0157285 A1 * 8/2003 Busshoff ..... B29C 63/20 428/36.4
2005/0034618 A1 * 2/2005 Barre ..... B41N 1/22 101/376
2007/0157559 A1 * 7/2007 Till ..... B41J 2/06 53/411

FOREIGN PATENT DOCUMENTS

DE 102007036752 A1 2/2009
EP 0209896 A2 1/1987
EP 0385624 A1 9/1990
EP 1 053 882 A 11/2000
EP 1435296 A1 7/2004
GB 2 376 920 12/2002
JP S 5747367 U 3/1982
JP S 63307950 A 12/1988
JP H05185661 A 7/1993
JP H09174900 A 7/1997
JP 2002-166532 6/2002
JP 2005-014255 1/2005
JP 2005-058898 3/2005
JP 2005058898 A 3/2005
JP 2005 138435 A 6/2005
JP 2005-531428 10/2005
RU 2232078 C2 7/2004
WO WO 03/103966 12/2003
WO WO 2004/009360 1/2004
WO WO2004113082 A1 12/2004
WO WO 2008/031930 3/2008

OTHER PUBLICATIONS

German Office Action 10 2007 050 493.6.
English translation of Chinese Office Action 200880111637.0.

* cited by examiner

BOTTLING PLANT WITH AN INFORMATION-ADDING STATION CONFIGURED TO ADD INFORMATION ON THE OUTER SURFACE OF A BOTTLE OR CONTAINER

CONTINUING APPLICATION DATA

This application is a Continuation-In-Part application of International Patent Application No. PCT/EP2008/007043, filed on Aug. 28, 2008, which claims priority from Federal Republic of Germany Patent Application No. 10 2007 050 493.6, filed on Oct. 19, 2007, and from Federal Republic of Germany Patent Application No. 10 2007 050 490.1, filed on Oct. 19, 2007. International Patent Application No. PCT/EP2008/007043 was pending as of the filing date of this application. The United States was an elected state in International Patent Application No. PCT/EP2008/007043.

BACKGROUND

1. Technical Field

The present application relates to a bottling plant with an information-adding station configured to add information on the outer surface of a bottle or container.

2. Background Information

Background information is for informational purposes only and does not necessarily admit that subsequently mentioned information and publications are prior art.

A beverage bottling plant for filling bottles with a liquid beverage filling material can possibly comprise a beverage filling machine, which is often a rotary filling machine, with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material.

Some beverage bottling plants may possibly comprise filling arrangements that receive a liquid beverage material from a toroidal or annular vessel, in which a supply of liquid beverage material is stored under pressure by a gas. The toroidal vessel may also be connected to at least one external reservoir or supply of liquid beverage material by a conduit or supply line. In some circumstances it may even be possible that a beverage bottling plant has two external supply reservoirs, each of which may be configured to store either the same liquid beverage product or different products. These reservoirs could possibly be connected to the toroidal or annular vessel by corresponding supply lines, conduits, or other arrangements. It is also possible that the external supply reservoirs could be in the form of simple storage tanks, or in the form of liquid beverage product mixers.

A wide variety of types of filling elements are used in filling machines in beverage bottling or container filling plants for dispensing a liquid product into bottles, cans or similar containers, including but not limited to filling processes that are carried out under counterpressure for the bottling of carbonated beverages. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine.

After a filling process has been completed, the filled beverage bottles are transported or conveyed to a closing machine, which is often a rotary closing machine. A revolving or rotary machine comprises a rotor, which revolves around a central, vertical machine axis. There may further be provided a conveyer arrangement configured to transfer filled bottles from the filling machine to the closing station. A transporting or conveying arrangement can utilize transport star wheels as well as linear conveyors. A closing machine closes bottles by applying a closure, such as a screw-top cap or a bottle cork, to a corresponding bottle mouth. Closed bottles are then usually conveyed to an information adding arrangement, wherein information, such as a product name or a manufacturer's information or logo, is applied to a bottle. A closing station and information adding arrangement may be connected by a corresponding conveyer arrangement. Bottles are then sorted and packaged for shipment out of the plant.

Many beverage bottling plants may also possibly comprise a rinsing arrangement or rinsing station to which new, non-return and/or even return bottles are fed, prior to being filled, by a conveyer arrangement, which can be a linear conveyor or a combination of a linear conveyor and a starwheel. Downstream of the rinsing arrangement or rinsing station, in the direction of travel, rinsed bottles are then transported to the beverage filling machine by a second conveyer arrangement that is formed, for example, by one or more starwheels that introduce bottles into the beverage filling machine.

It is a further possibility that a beverage bottling plant for filling bottles with a liquid beverage filling material can be controlled by a central control arrangement, which could be, for example, a computerized control system that monitors and controls the operation of the various stations and mechanisms of the beverage bottling plant.

In some apparatuses for printing bottles or similar containers, the container region to be printed is located directly adjacent or substantially adjacent one or more print heads during the printing process. Furthermore, in some apparatuses, where the printing is effected by the container region to be printed rolling off a printing block colored with printing ink, the printing block being provided at a rotating printing drum or at a rotating belt.

In some apparatuses for printing containers, the containers, which are located in receiving means of a transport wheel that is rotatingly driven about a horizontal machine axis, are moved past a printing position; at the printing position each container, by way of its container region to be printed, rolls off one of many transfer surfaces each provided with a negative print image. These are formed at a star-shaped circumference of a print wheel that is also driven rotatingly about a horizontal axis. To create the negative print images, a plurality of print heads are provided at the periphery of the print wheel, the print heads being designed in the manner of an ink jet print head and by way of each of which a color set of a multi-colored print image is created.

High quality printing of containers, i.e. high qualitative printing, for example also printing that is sharp and distortion-free and/or with zero defects, is possible using these apparatuses if the containers to be printed have the smallest possible dimensional tolerances and have no, or as little as possible, unevenness at their region to be printed.

OBJECT OR OBJECTS

An object of the present application is to provide an apparatus that makes it possible to print bottles or similar containers with high quality and with a high output (number of printed containers per unit of time).

SUMMARY

This object is achieved with an apparatus for printing bottles or similar containers on an outer surface of a container, the apparatus having at least one printing station, the containers being moved past the print region of the printing station on a container conveyor, and at least one print head and a transfer element, which forms at least one transfer surface, is provided at an auxiliary conveyor and is moved by way of the auxiliary conveyor at least between the at least one print head and the print region for applying a negative print image onto the at least one transfer surface for transferring the negative print image onto a container region rolling off the transfer surface. The transfer surface is resilient or springy.

The embodiment according to the present application makes it possible, among other things, to print even bottles or similar containers that have relatively large dimensional tolerances and/or unevenness, directly on the outer surface of the container with high quality and with a high output.

Further developments, possible embodiments, and application possibilities of the present application are produced from the following description of possible embodiments and from the figures. In this case, described and/or graphically represented features, individually per se or in arbitrary combination, in principle, are objects of the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present application is described below by way of the figures of possible embodiments, in which, in detail.

DESCRIPTION OF EMBODIMENT OR EMBODIMENTS

Figure 1:
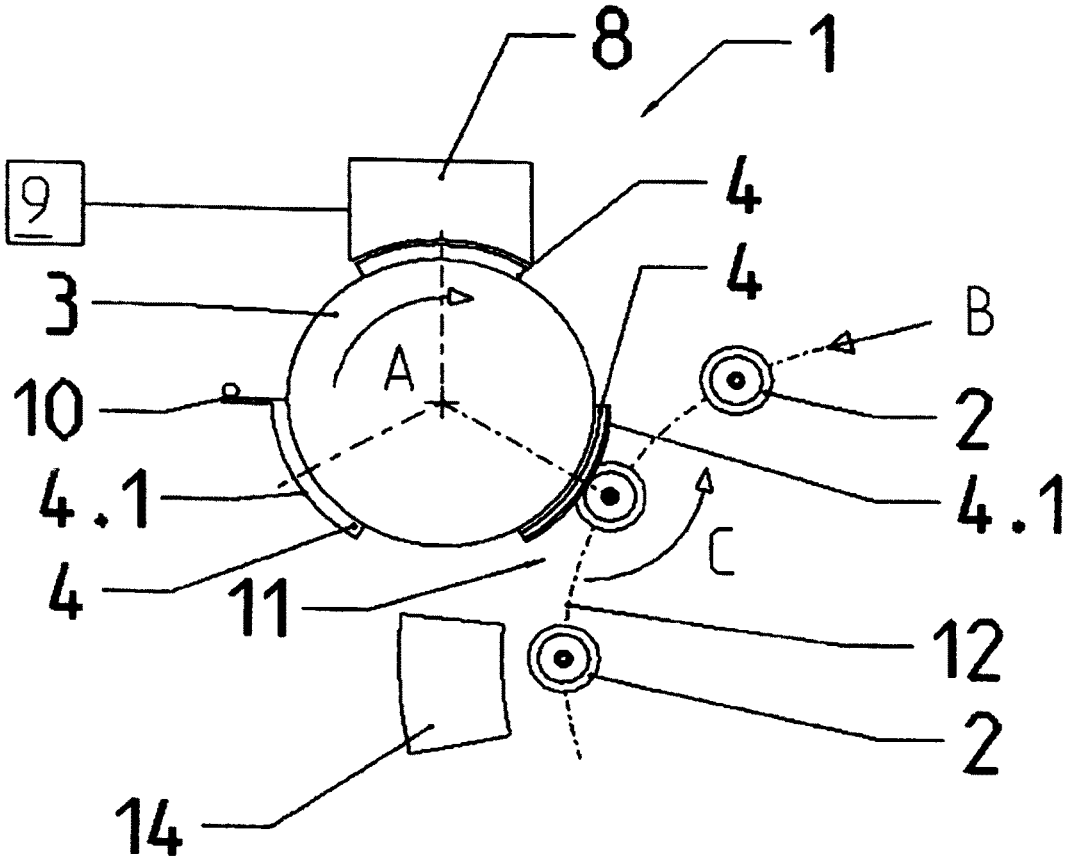
FIG. 1 shows a very simplified representation of a top view of a printing station for printing bottles and similar containers on a circular or substantially circular outer surface of a container, together with bottles moved past the printing station on a container conveyor.
Figure 2:
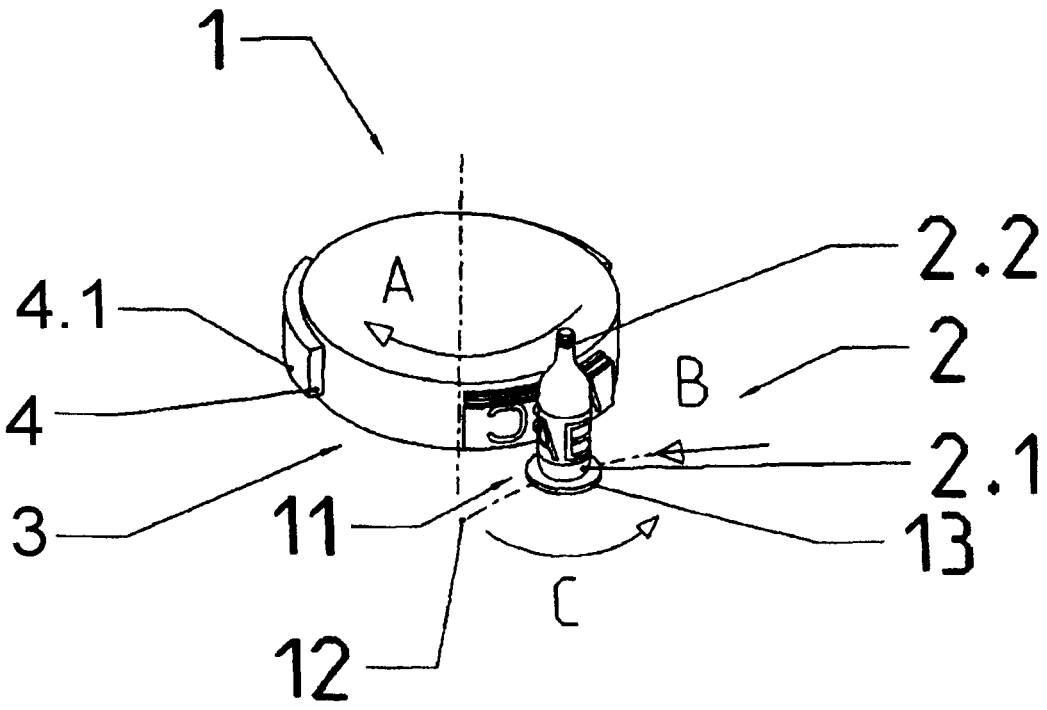
FIG. 2 shows a simplified representation in perspective of the transfer drum of the printing station in FIG. 1 with the transfer elements, together with a bottle standing upright on a container carrier.
Figure 3:
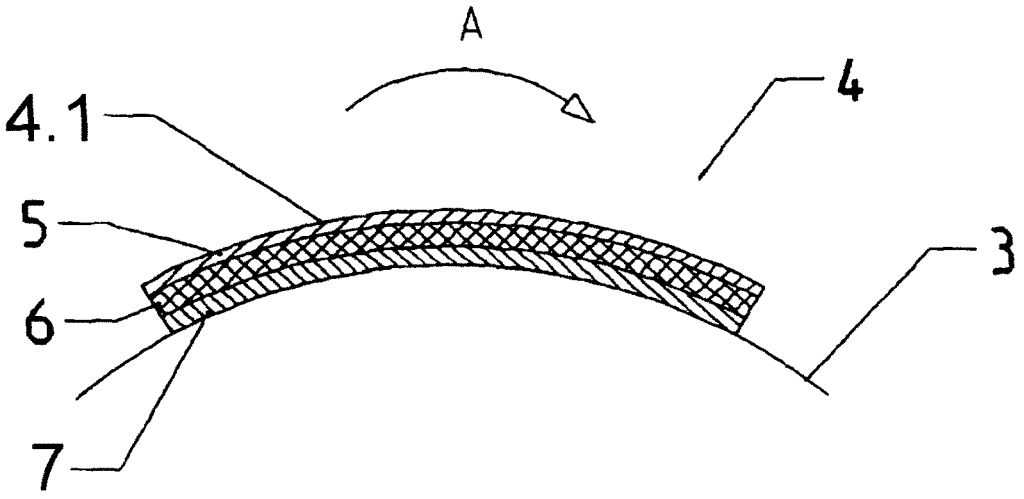
FIG. 3 shows an enlarged representation of a section through a transfer element of the printing station in FIG. 1.

The printing station, given the general reference 1 in FIGS. 1 through 3, is used for printing bottles 2 directly on a, for example, circular or substantially circular region of the outer surface of a bottle, for example on a bottle belly 2.1, as represented, or also on a bottle neck 2.2.

The printing station 1 comprises, amongst other things, a transfer drum 3 that is driven in a rotating manner about its vertical axis in the direction of the arrow A, a plurality of transfer elements 4 being offset about the drum axis at regular angular spacings on the circular circumferential surface of the transfer drum, i.e. in the embodiment represented a total of three transfer elements 4 being provided in one possible embodiment so as to be replaceable. As is shown in FIG. 3, each transfer element 4 is multi-layered, i.e. it is produced, amongst other things, from one adhesive layer 5 that lies at the outside, with reference to the axis of the transfer drum 3, and is made from a material suitable for a transfer print, from one rubber elastic intermediate layer 6 that connects to the adhesive layer 5, for example made from a harder rubber or an elastomeric plastics material, as well as from one carrier layer 7 that connects to the intermediate layer 6 and is made from a metallic material or a plastics material, by means of which the respective transfer element 4 is secured to the circumference of the transfer drum 3. Each transfer element 4, on its outside or transfer surface 4.1 that is formed by the adhesive layer 5, is curved in a part circular cylindrical manner about the axis of the transfer star 3 and there is deformable in the manner of a cushion but without any folds.

The printing station 4 also includes a print head 8, which is located at the periphery of the transfer drum 3 so as not to rotate with the transfer drum and by way of which in each case the complete print image to be applied onto a bottle 2 in negative or mirror-inverted form, i.e. as a negative printed image is applied onto the transfer surface 4.1 of the transfer elements 4 moved past the print head 8 when the transfer drum 3 rotates. In other words, the print head 8 may be stationary and may be disposed adjacent to the transfer drum or transfer rotor 3. The transfer rotor 3 may be configured to rotate. The print head 8 is in one possible embodiment an electronic print head and, for a multi-color print, includes a plurality of electronically actuatable individual print heads, which are provided consecutively in the direction of rotation A, for example one single print head for black and a plurality of individual print heads for the different color sets of a multi-color print.

The individual print heads are, for example, those that are known under the designation "tone jet" and which, in each case, have a multiple of nozzle openings in a row, which is oriented parallel or substantially parallel to the axis of the transfer drum 3. An electrode is associated with each nozzle opening. The individual print heads or their electrodes are actuated by a control device 9 electronically creating the print image, in such a manner that where there is a change in the potential of the associated electrode relative to the potential of the nozzle openings, print ink is applied at the nozzle openings to create an image dot on the transfer surface 4.1.

A cleaning station or cleaning position 10 is provided preceding the print head 8 in the direction of rotation A at the periphery of the transfer drum 3 and not rotating with the transfer drum 3, at which cleaning station 10 the transfer elements 4, moved past by way of the transfer drum 3, are cleaned before the new negative print image is applied, i.e. any residual printing ink present is removed. The cleaning station 10 is formed in the simplest case by one or more scrapers.

Each transfer element 4, provided with the negative print image on the transfer surface 4, arrives by way of the rotating transfer drum 3 at a print region 11 when a bottle 2, standing upright at that location on a bottle or container conveyor 12, i.e. oriented with its axis in the vertical or substantially vertical direction, is moved past. The container conveyor 12, in the embodiment represented in FIGS. 1 through 3, is a turntable or rotor that is driven in a rotating manner about a vertical or substantially vertical machine axis synchronously or substantially synchronously with the transfer drum 3, with a plurality of plate-shaped container carriers 13 which are provided offset at regular angular spacings about the vertical or substantially vertical machine axis of the rotor on its circumference and are rotatable in a controlled manner about their vertical or substantially vertical machine axes. By way of the respective container carrier 13, each bottle 2, which is secured against falling over at its upper end by an element (not represented), for example by a plunger, is rotated at the print region 11 about its bottle axis (arrow C) in such a manner that the bottle 2, by way of the region to be printed (for example bottle belly 2.1), in a non-slip manner rolls off the transfer element 4 or the transfer surface 4.1 moved past and consequently the negative print image from the respective transfer element 4 is applied onto the bottle 2 concerned as a positive print.

In at least one possible embodiment of the present application, the transfer drum or transfer rotor 3 may rotate about a vertical or substantially vertical axis in the direction of rotation A. The transfer elements 4 may be disposed adjacent to and connected to the outer circumference of the transfer rotor 3. Thus, the transfer elements 4 may be moved past the print head 8 in the direction of rotation A as the transfer rotor 3 rotates. The print head 8 may be configured to apply information or an image on the transfer elements 4 as the transfer elements 4 move past the print head 8. In at least one possible embodiment, the image applied to the transfer element 4 may be an inverse image, or mirrored image, or negative image, or reversed image. In at least one possible embodiment, the printing medium may be ink. In at least one other possible embodiment, the printing medium may be paint. Each bottle 2, standing upright on the associated container carrier 13 and printed in this manner, then continues to be moved by way of the container conveyor 12, and, amongst other things, arrives at a station 14, at which the print image applied directly onto the bottle 2 is dried, set or fired-in through the effect of energy or the application of energy, for example through infrared radiation, UV radiation, microwave energy, hot air, etc., in one possible embodiment with the bottle 2 continuing to be rotated about its bottle axis by way of the container carrier 13.

A characteristic of the printing station 1 is that, when the bottles are moved past the print head 8, the complete print image to be applied to the bottle 2 is created on each transfer surface 4.1, in each case in negative form. In order to obtain a high quality print image, in one possible embodiment also one that is clean, zero defect and sharp, it is necessary and/or desired for a precisely or substantially precisely predetermined spacing to be maintained in an accurate manner between the transfer surface 4.1 and the print head 8 or the individual print heads. This is possible and does not pose any problems.

The resilient intermediate layer 6 essentially ensures or promotes that even with dimensional tolerances, e.g. tolerances in the diameter of the bottles 2 that can certainly be in the range of between 0.5 millimeter to 0.7 millimeter, and also in the case of unevenness, the close abutting of the transfer surface 4.1 against the bottle region to be printed that is necessary and/or desired for the transferring of the print image from the transfer element 4 to the respective bottle 2 is essentially ensured or promoted. Consequently, in one possible embodiment of the present application, the printing station 1 may make possible a high quality print whilst at the same time the very critical or substantially critical spacing between the print head 8 and the transfer surfaces 4.1 is maintained, in spite of considerable dimensional tolerances between the bottles 2, the tolerances being compensated by the resilient design of the transfer elements 4, i.e. in the resilient intermediate layers 6.

In at least one possible embodiment of the present application, the transfer element 4 may be configured to compensate for 0.5 millimeters to 0.7 millimeters of diameter tolerance in the outer surfaces of the beverage bottles 2. The transfer element 4 may also be configured to compensate for variances, unevenness, and/or surface roughness in the outer surfaces of the beverage bottles 2. The transfer element 4 may comprise an arc-shape or curve which conforms to the outer circumference of the transfer drum or transfer rotor 3. The transfer element 4 may comprise an adhesive layer or outer layer 5, an intermediate layer 6, and a carrier layer 7. The adhesive or outer layer 5 may comprise an arc-shape or curve which conforms to the outer circumference of the transfer rotor 3. The outer layer 5 may comprise a transfer surface 4.1. The transfer surface 4.1 may be configured to accept a printed image from the print head 8. The transfer surface 4.1 may be configured transfer a printed image onto the outer surface of a beverage bottle 2, for example, onto the bottle belly 2.1 or the bottle neck 2.2. The transfer surface 4.1 may be configured to come in contact with the outer surface of the beverage bottle 2, thereby transferring the printed image onto the outer surface of the bottle 2. The outer layer 5 of the transfer element 4 may comprise a material which is sufficiently firm to permit the transfer surface 4.1 to accept an image from the print head 8. The outer layer 5 may comprise a material that is also sufficiently resilient to compensate for variances, unevenness, surface roughness, and/or diameter tolerances in the outer surfaces of the beverage bottles 2. The outer layer 5 may be configured to compensate for 0.5 millimeters to 0.7 millimeters of diameter tolerance in the outer surfaces of the beverage bottles 2. The outer layer 5 may comprise a material which is sufficiently firm to permit the transfer surface 4.1 to transfer an image to the outer surface of a bottle 2 with no distortion, substantially no distortion, or essentially no distortion of the image. The outer layer 5 may comprise a material that is sufficiently firm to transfer an image from the transfer surface 4.1 to the beverage bottle belly 2.1 with no distortion, substantially no distortion, or essentially no distortion of the image. The outer layer 5 may comprise a material that is sufficiently firm to transfer an image from the transfer surface 4.1 to the beverage bottle neck 2.2 with no distortion, substantially no distortion, or essentially no distortion of the image.

The outer layer 5 may be disposed adjacent to and connected to the intermediate layer 6 of the transfer element 4. The intermediate layer may be disposed between the outer layer 5 and the carrier layer 7. The intermediate layer may comprise an arc-shape or curve which conforms to the outer circumference of the transfer rotor 3. The outer layer 5 may comprise a transfer surface 4.1. The intermediate layer may be configured to compensate for 0.5 millimeters to 0.7 millimeters of diameter tolerance in the outer surfaces of the beverage bottles 2. The intermediate layer 6 may comprise a material that is sufficiently firm to permit the transfer surface 4.1 to transfer an image to the outer surface of the beverage bottle 2 with no distortion, substantially no distortion, or essentially no distortion of the image. The intermediate layer 6 may comprise a material that is sufficiently firm to apply an image to the beverage bottle belly 2.1 distortion, substantially no distortion, or essentially no distortion of the image. The intermediate layer 6 may comprise a material that is sufficiently firm to apply an image to the beverage bottle neck 2.2 with no distortion, substantially no distortion, or essentially no distortion of the image. The intermediate layer 6 may comprise a rubber or an elastomeric plastics material, such as PTE. The intermediate layer 6 may be comprised of a material sufficiently resilient to compensate for variances, surface roughness, and diameter tolerances in the surface of beverage bottles 2.

The carrier layer 7 may be adjacent to and connected to the outer circumference of the transfer drum or transfer rotor 3. The carrier layer may be adjacent to and connected to the intermediate layer 6. The carrier layer 7 may connect the transfer element 4 to the outer circumference of the transfer rotor 3. The carrier layer 7 may be comprised of metal. In at least one possible embodiment of the present application, the carrier layer may be comprised of plastic.

Figure 4:
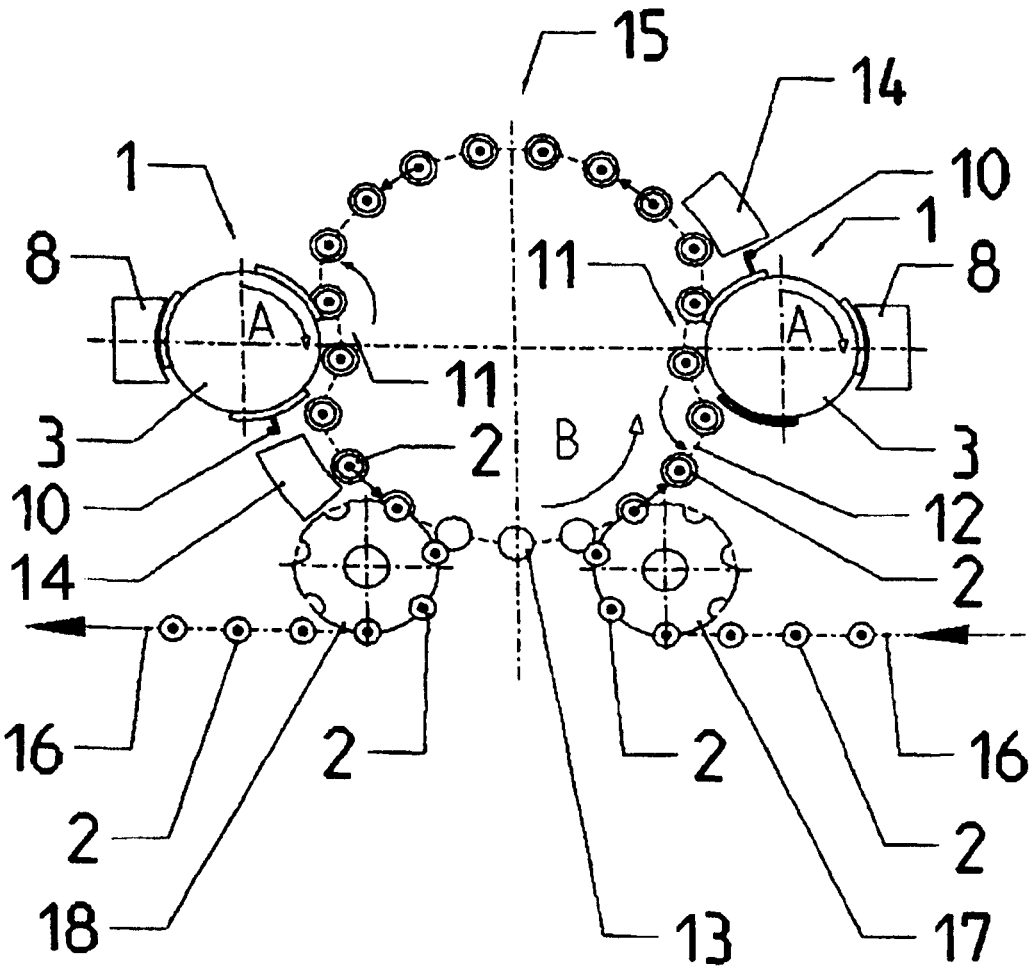
FIG. 4 shows a schematic representation and top view of an apparatus for printing bottles or similar containers on circular outer surfaces of containers by way of two printing stations.

FIG. 4 shows an apparatus 15 for printing bottles 2 or similar containers, the apparatus having, in its turn, the container conveyor 12, which is in the form of a rotor and is driven rotatingly about a machine axis in the direction of the arrow B, with the container carriers 13 provided on the circumference. At the periphery of the container conveyor 12 there are two printing stations 1; in the embodiment represented they are offset one relative to the other by one hundred eighty degrees about the vertical axis of rotation of the container conveyor 12.

In the case of the apparatus 15, the container carriers 13 are not only rotatable in a controlled manner about their vertical container carrier axes, but at the same time, with reference to the vertical or substantially vertical axis of the container conveyor 12, are also moveable in a controlled manner radially or substantially radially so that the container carriers 13 or the bottles 2 located standing upright on the container carriers, are rotated at the print region 11 of each printing station 1 not only about the vertical or substantially vertical axis of the container carriers 13 (arrow C) but are also moved on a curved path about the axis of the respective transfer drum 3, for example on a part circular path. In this way the angular region of the rotational movement of the container conveyor 12 useable for the transferring of the print image from the transfer elements 4 onto the bottles 2 is increased in a considerable manner, such that high quality printing of the bottles 2 is essentially ensured or promoted with the device 15 achieving a high or optimum output (number of printed bottles 2 per unit of time).

The bottles 2 are supplied to the apparatus 15 by means of a conveyor belt 16 and each arrive individually via an inlet star 17 on a container carrier 13. The printed bottles 2 are removed from the respective container carrier 13 at an outlet star 18 and are forwarded on by way of the conveyor belt 16. By way of the two printing stations 1, printing is effected on the bottles 2 at different regions 11, for example at the bottle belly 2.1 by way of the one printing station 1 and at the bottle neck 2.2 by way of the other printing station 1. In principle, however, it is also possible to supplement the print image created by way of the printing station 1 that is first in the transport direction B, with the printing station 1 that is following in the transport direction B, also, for example, differing individually from bottle 2 to bottle 2 or differing individually from bottle group to bottle group.

A drying station 14 for drying, setting and/or firing-in the print image is provided in its turn in the transport direction B following each printing station 1.

Figure 5:
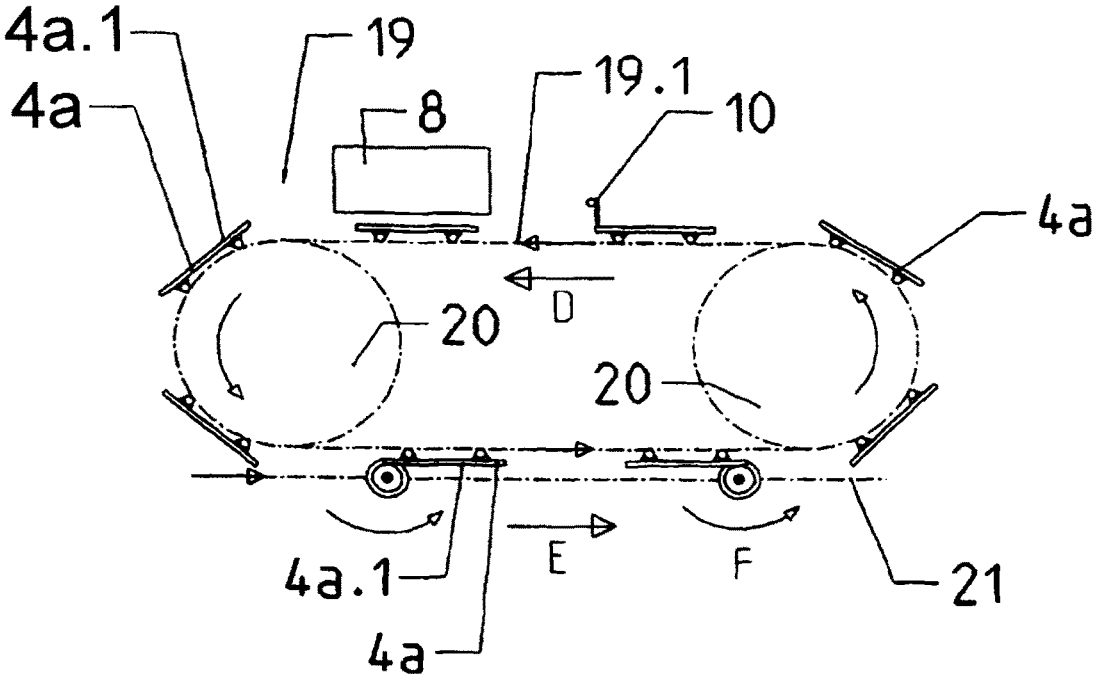
FIG. 5 shows a simplified representation and top view of another embodiment of the printing station according to the present application which has a plurality of transfer elements provided on an auxiliary conveyor and is driven in a rotating manner with the auxiliary conveyor.
Figure 6:
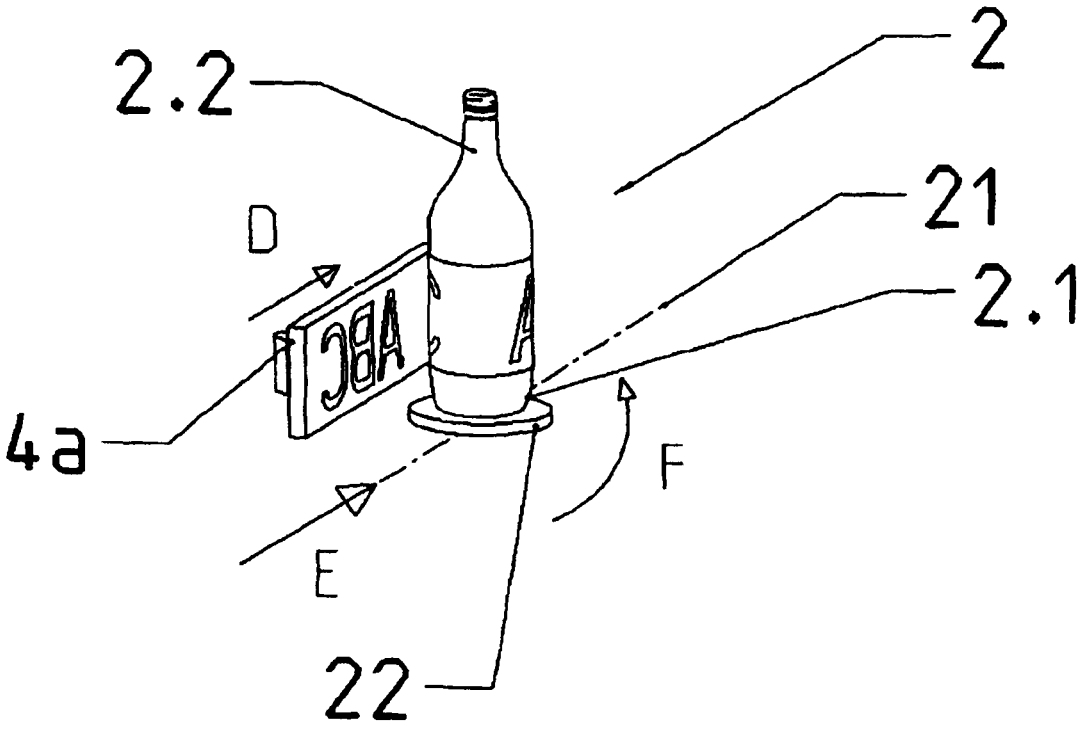
FIG. 6 shows a perspective representation of one of the transfer elements in FIG. 5 together with a bottle standing upright on a container carrier.

As another embodiment, FIGS. 5 and 6 show a printing station 1*a* which differs from the printing station 1 essentially in that the transfer elements 4*a*, corresponding to the transfer elements 4 as regards their function and their design, are provided on an auxiliary conveyor in the form of at least one belt-shaped, band-shaped or chain-shaped transport element 19 that forms a closed oval loop and is driven (arrow D) in an endlessly rotating manner. The transport element 19 is guided via at least two wheels that are indicated in FIG. 5 by the reference 20 and support the transfer elements 4*a* on the outside of the loop. Each transfer element 4*a*, in its turn, is produced from the adhesive layer forming the transfer surface 4*a*.1, the resilient intermediate layer and a carrier element with which the transfer element 4*a* is retained at the transport element 19. Contrary to the transfer elements 4, the transfer elements 4*a* are planar or substantially planar on their transfer surface 4.1. The print head 8 and the cleaning station 10 that precedes the print head 8 in the direction of transport D of the transport element 19 are provided on a rectilinear loop length 19.1 of the transport element 19.

The print region 11*a* is formed on the loop length 19.2 of the transport element 19, the loop length also being rectilinear and lying opposite the loop length 19.1, and the bottles 2, standing upright on a container conveyor 21 or on plate-like container carriers 22 at that location, are moved past the print region 11*a* in a straight line, with the container carriers 22 and the bottles 2 rotating about their vertical or substantially vertical axes (arrow E) in such a manner that each bottle 2 rolls off a transfer element 4*a* in a non-slip manner or off the transfer surface 4*a*.1 located there in a vertical or substantially vertical plane for transferring the negative print image.

The method of operation of the printing station 1*a* corresponds to the method of operation of the printing station 1, i.e. a complete negative print image is created in each case on the transfer surfaces 4*a*.1 when the bottle is moved past the print head 8 and the negative print image is then transferred to a bottle 2 at the print region 11*a*. Before reaching the print head 8, the respective transfer surface 4*a*.1 is cleaned at the cleaning position 10 or is relieved of print ink residue by means of scrapers. The printed bottles 2 are moved along by means of the container conveyor 21, among other things to a drying station that corresponds to the drying station 14 (not shown).

In at least one possible embodiment of the present application, the printing station 1*a* may comprise a relatively large length of the transport section of the container conveyor 21 being available for the transferring of the negative print images from the transfer elements 4*a* onto the bottles 2, which means that the printing station 1*a* is also in one possible embodiment suitable for very high outputs, or maximize output of printed bottles 2.

Figure 7:
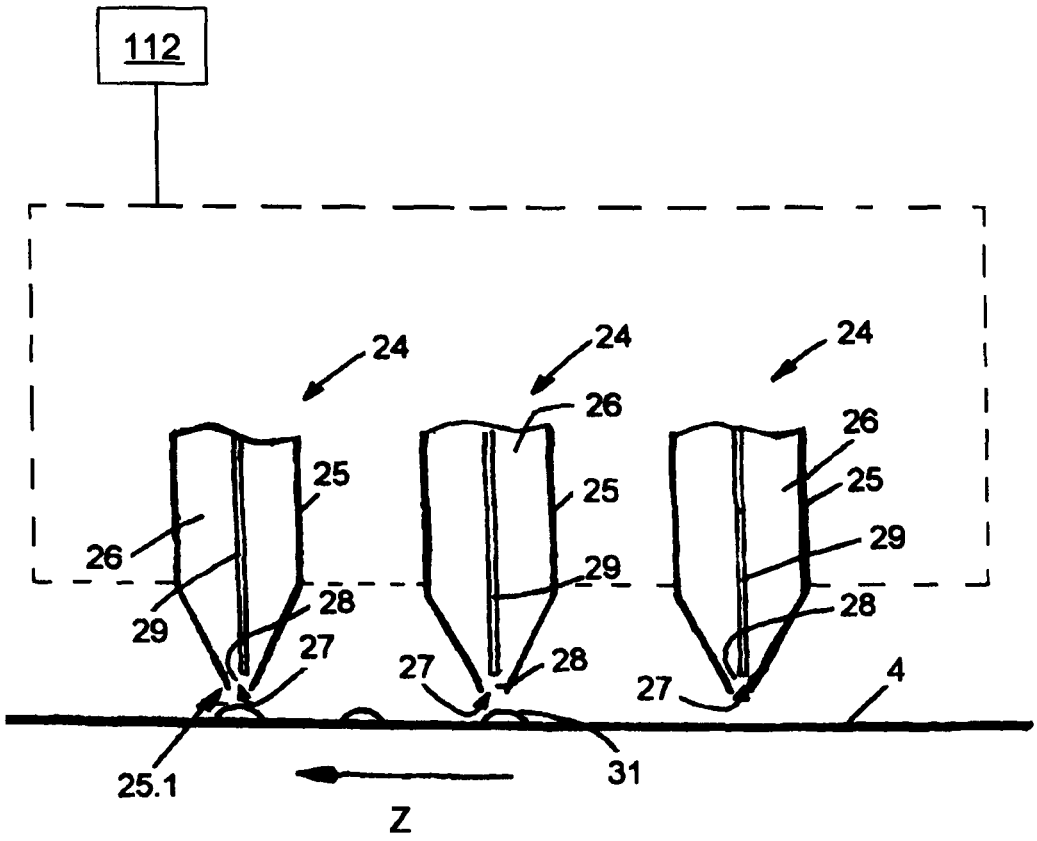
FIG. 7 is a schematic illustration showing the print heads of a printing unit which is realized in the form of electrostatic print heads together with the film material to be printed.

The printing station 1 may comprise a plurality of print heads, as seen in FIG. 7. The plurality of print heads 24 may be oriented at a right angle or virtually perpendicular to the direction of travel Z of the transfer element 4 at a short distance above this material or above the printing plane formed by the transfer element 4. In the illustrated embodiment seen in FIG. 7, this printing plane is a horizontal plane. In other possible embodiments of the present application, the plane may be linear or curved, and the printing plane may not be a horizontal plane.

To promote optimum printing performance (number of impressions per unit of time) with the optimum possible printing quality, in this embodiment the print heads 24 are realized in the form of electrostatic print heads. For multi-color printing, there may be at least three print heads, each of which is used to print one color set of a multi-color printing. The printing heads thus comprise, in their coloring, different colors of ink, e.g. red, blue, and yellow. Basically it is also possible to provide additional print-heads 24 in the printing station 1, for example a fourth print head 24 for black ink.

As also shown in FIG. 7, the print head 24 comprises a housing 25 which forms, among other things, a closed interior compartment 26 which holds the liquid or viscous ink. Each housing 25 is designed so that the interior compartment 26 tapers in a cone or wedge shape toward a lower housing segment 25.1. On this housing segment 25.1, which extends over the entire length of each print head 24 or the print head housing 25 and is oriented parallel or substantially parallel to a longitudinal axis DL of the housing or print head and thus also parallel or substantially parallel to the printing plane, there are a plurality of individually activated nozzles 27 for the controlled dispensing of the ink or printing medium, and possibly in at least one row sequentially in the direction of the longitudinal axis DL of the print head 24 and arranged close together, so that, for example, one hundred and fifty individual nozzles 27 per inch or more are formed on the housing segment 25.1. With the housing segment 25.1 that has the individual nozzles 27, each print head 24 is located at the above mentioned short distance above the transfer element 4 to be printed or the printing plane. The transfer element 4 is continuously or substantially continuously moved forward past the respective print head 24 during the printing in the direction of travel Z. As a result of the above mentioned orientation of the print heads 24, in at least one embodiment the direction of forward movement or travel Z is at a right angle, that is perpendicular or substantially perpendicular to the print head longitudinal axis DL of the print heads 24. In the illustrated embodiment seen in FIG. 7, the print heads 24 are arranged with their longitudinal axes DL of the print heads parallel or substantially parallel to one another in the horizontal direction, and in at least one embodiment in a common horizontal plane.

Each individual nozzle 27 comprises an aperture 28 and a needle-shaped electrode 29 that corresponds to this aperture 28. The axis of the electrode 29 is oriented equi-axially with the axis of the respective aperture 28 and ends at a slight distance from this aperture 28 inside the housing interior compartment 26. Each print head 24 may also be realized so that, at least during the printing process, the ink that is in the housing interior compartment 26 is pressed at a certain hydrostatic pressure toward the apertures 28 of the individual nozzles 27. The cross section of the openings 28, however, is selected taking the viscosity and/or the surface tension of the ink into consideration so that when the individual nozzle 27 is not activated, ink or printing medium does not exit the apertures 28 in spite of the hydrostatic pressure.

The electrodes 29 can be actuated individually by means of a control device 112, and possibly so that when the individual nozzle 27 is not activated, the corresponding electrode 29 is at the same electrical potential as the ink in the interior 26 of the housing. When an individual nozzle 27 is activated, the potential of the corresponding electrode 29 is varied briefly or in a pulsed fashion by a corresponding activation or actuation by the control device 112, so that ink or printing medium is dispensed via the aperture 28 to produce a printed dot 31 on the transfer element 4.

Because the print heads 24 are oriented with the longitudinal axis DL of their print head at a right angle or perpendicular or substantially perpendicular to the direction Z of forward travel of the transfer element 4, the printing on the transfer element 4 is often done in rows that run perpendicular or substantially perpendicular to the longitudinal direction or direction of forward travel Z of the transfer element 4 over the entire width of the area to be printed, e.g. over a large part of the width of the transfer element 4, and possibly progressively in the direction of forward travel Z of the transfer element 4. The individual nozzles 27 can be activated at high speed. For the printing, moreover, a single relative movement between the transfer element 4 and the respective print head 24, namely only which movement, in at least one embodiment, comprises the forward movement of the transfer element 4. For these reasons, a high print output may be achieved. The respective image is generated digitally in the control device 112 by a corresponding actuation of the individual nozzles 27 and is stored in the control device 112 or in a memory of the control device in the form of a digital dataset.

The transfer element 4 may be printed at the printing station 1 so that the imprint and/or the graphic and/or color layout or decoration printed on the transfer element 4 is produced by the printing station 1 on the transfer element 4 and/or an imprint that is already present on the transfer element 4 is supplemented in a desired fashion with the printer station 1, e.g. text, colors or graphics can be added. Various advantageous capabilities, i.e. among others the ability to rapidly convert the printing station 1 to different products, to set and/or adjust the size of the current printed impression to the size of the bottles or containers 2, become possible because the transfer element 4 is printed in the device 1, i.e. immediately or essentially immediately before the transfer element 4 is used to transfer an image onto an outer surface of a bottle 2, and as a result of the activation of the printer station 1 or of the print heads 24 located in it by the electronic control unit 112 with the use of digital print forms or templates stored in the printer unit. It is also possible to easily modify the impression on the transfer element 4 simply by reprogramming or modifying a program in the electronic control device 112. It is also possible, among other things, during the printing process, to change the impression and thus the image transferred to a bottle 2, e.g. to reformat or redesign the printed image to be transferred to each bottle or container 2, often so that each printed image may be then composed of a constant, unchanging component and variable text and/or information. The components of the printed image that vary can, for example, be numerical or alphanumerical information, e.g. information relating to the manufacturing date, the use-by date or information in the form of a numerical code, etc.

It goes without saying that the forward movement of the transfer element 4, at least in the vicinity of the print heads 24, may be regulated by the electronic control device 112, and possibly in synchronization or substantial synchronization with the actuation of the print heads 24, to thereby achieve a clear, high-quality printed image. It further goes without saying that centering and guide means for the transfer element 4 are provided in the vicinity of the print heads 24 to optimally orient this material with reference to the print heads 24, and/or to comply with the specified distance or desired distance between the print heads 24 and the transfer element 4.

Figure 8:
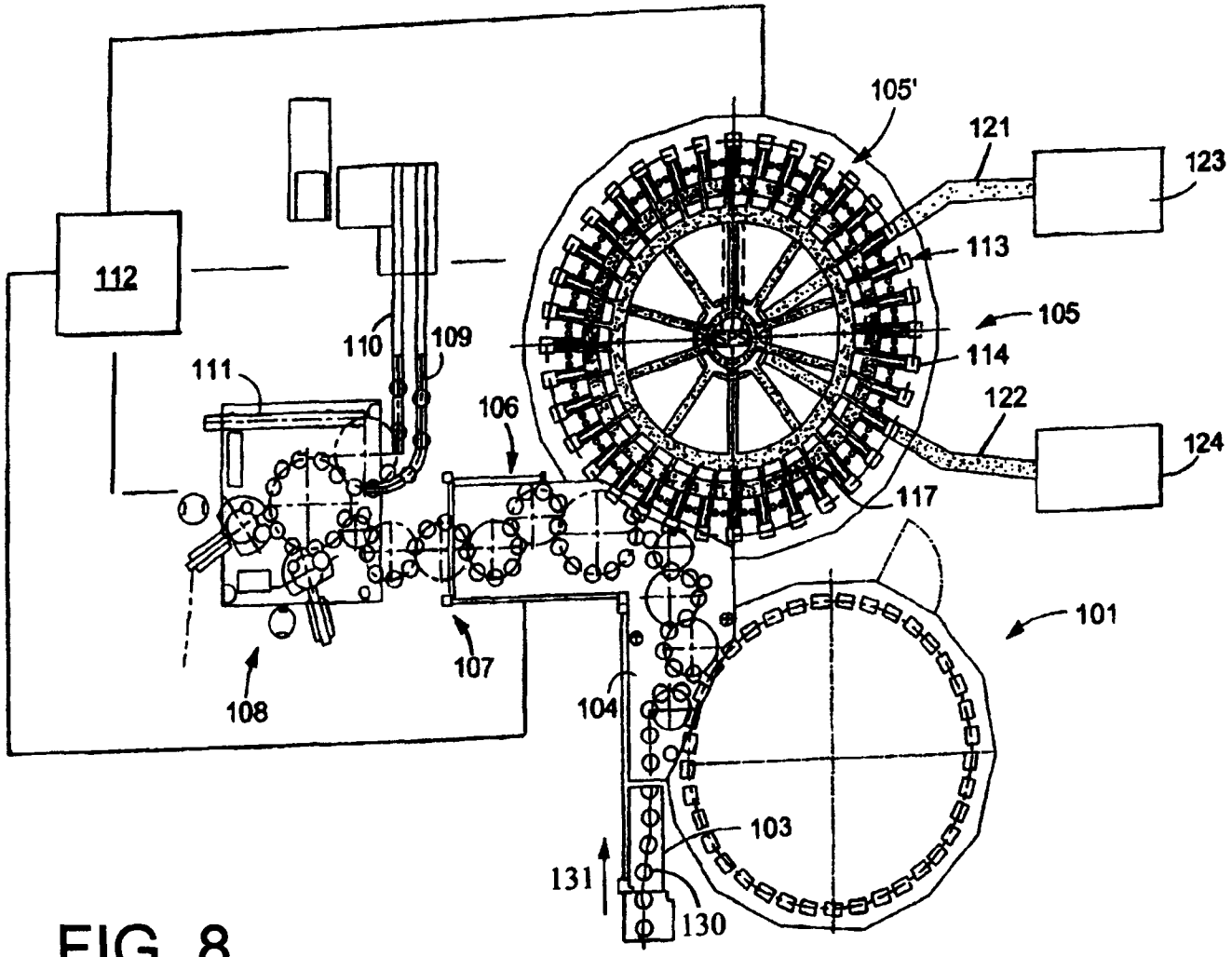
FIG. 8 shows schematically the main components of one possible embodiment example of a system for filling containers, for example, a beverage bottling plant for filling bottles or containers with at least one liquid beverage, in accordance with at least one possible embodiment, in which system or plant could possibly be utilized at least one aspect, or several aspects, of the embodiments disclosed herein.

FIG. 8 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 8 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 8, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

Figure 9:
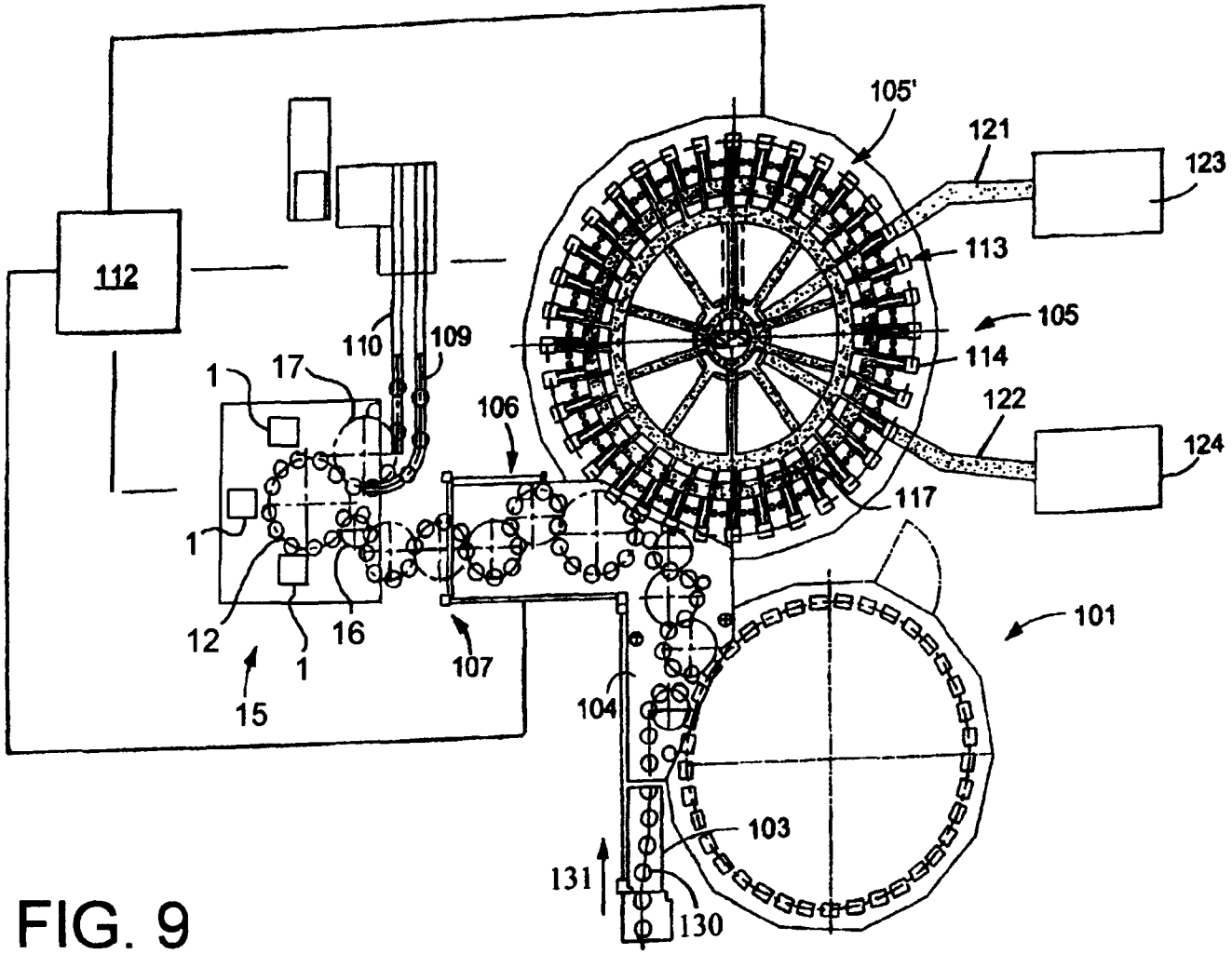
FIG. 9 shows schematically the main components of a possible system for filling bottles or containers including one possible embodiment of the present application.

FIG. 9 shows one possible embodiment for filling bottles or containers with a filling material, for example a liquid beverage material. In the embodiment shown in FIG. 9, filled, closed bottles or containers 130 may be transferred, conveyed, and/or moved from a conveyor arrangement 107 to the apparatus or printing machine or labeling machine 15 of the present application. Bottles or containers 130 may be moved from the conveyor 107 to the inlet or inlet starwheel 17. The inlet starwheel 17 may then feed the filled, closed bottles 130 to the rotor 12. The rotor 12 may then rotate the bottles 130 past a plurality of printing stations 1 of the present application. Each printing station 1 may be configured to print and transfer an image, or information in the form of an image, onto the filled, closed bottles 130 disposed on the rotor 12. The filled, closed bottles 130 that are now labeled with information and/or an image may then be moved from the rotor 12 to an outlet or outlet starwheel 18. The outlet starwheel 18 may then transfer or move the filled, closed, labeled containers or bottles 130 to the conveyor 109.

Figure 10:
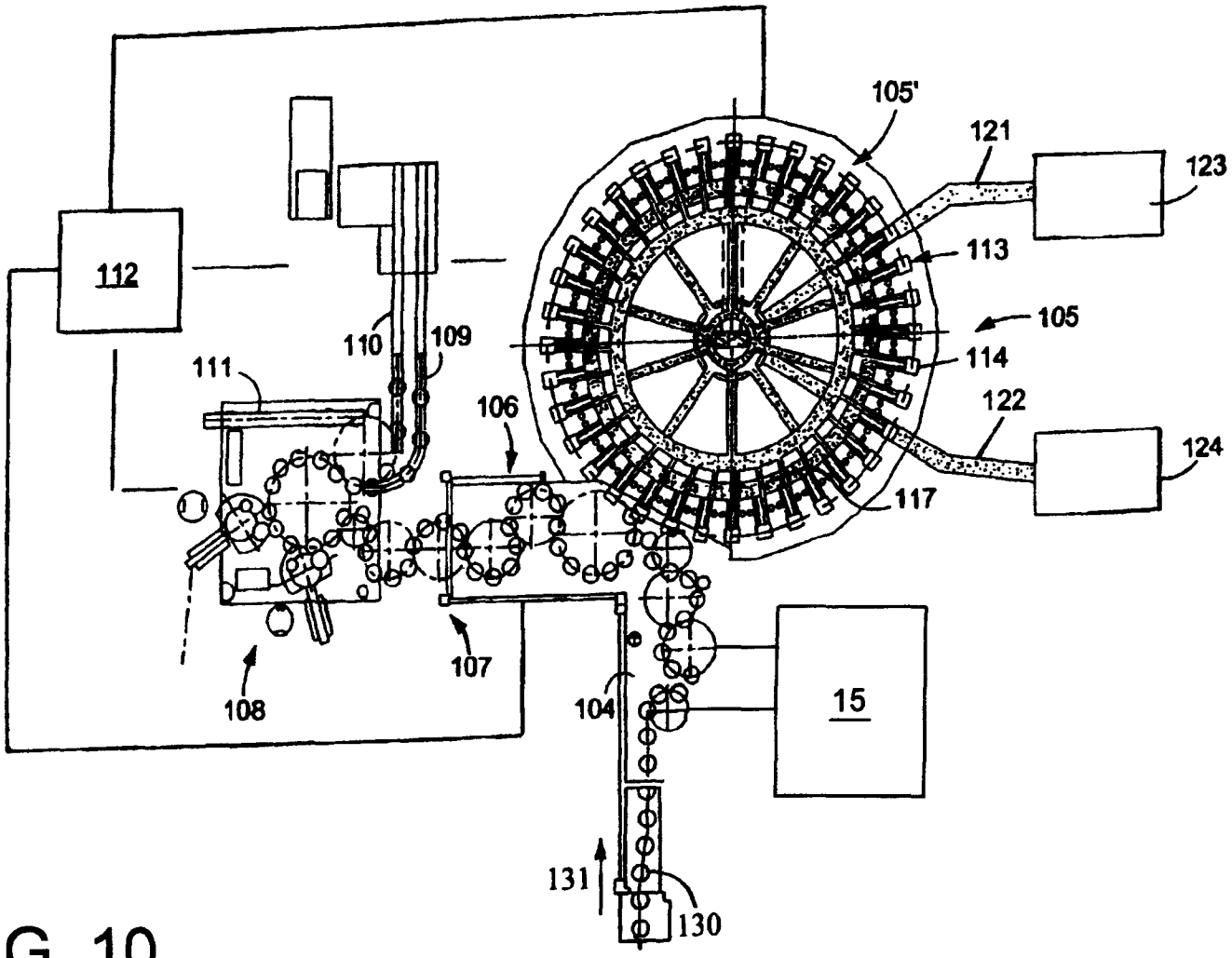
FIG. 10 shows schematically the main components of a possible system for filling bottles or container including one possible embodiment of the present application.

FIG. 10 shows one schematic embodiment of the present application, in which a bottling plant comprises a filling machine 105, a closing machine 106, a labeling machine 108, a control device 112, and an apparatus or printing machine or labeling machine 15 of the present application. The printing machine 15 comprises a conveyor 16, an inlet 17, an outlet 18, a rotor 12, a plurality of printing regions or positions 11, and a plurality of printing stations 1. The printing stations 1 may comprise a transfer drum 3, a plurality of transfer elements 4 and 4*a*, a print head or print head arrangement 8, a control device 9, a cleaning station 10, and a drying station 14.

In the plant seen in FIG. 10, bottles or containers 130 may be moved to a printing machine 15. The empty bottles or containers 130 may be labeled with information and/or an image in the printing machine 15. In the apparatus 15, an image or information may be printed on a transfer element 4. The transfer element 4 may then transfer the printed image or printed information onto an empty bottle 130. Once the information or image is transferred onto an outer surface of the beverage bottle 130, the empty, labeled bottle 130 may be moved into the filling machine 105. The labeled bottle 130 may be filled in the filling machine 105, and then the labeled, filled bottle 130 may be then transferred to the closing machine 106. The labeled, filled bottle 130 may be closed in the closing machine 106. The labeled, filled, closed bottle or container 130 may then be transferred out of the closing machine 106 and further processed in the bottling plant.

The present application has been described above by way of possible embodiments. It is obvious that numerous changes and conversions are possible without departing thereby from the teaching concept that underlies the present application.

Thus, it has been assumed above that the container conveyor 21 is a linear container conveyor and that accordingly the transfer elements 4*a* are moved at the print region 11*a* over a rectilinear loop length 19.2 of the transport element 19. It is also possible, in principle, to guide the transport element 19 and consequently also the transfer elements 4*a* at the print region 11*a* on a curved path, for example on a path curved in a part circular manner so that the corresponding printing station can then also be located at the periphery of a container transporter in the form of a rotor that rotates about a vertical or substantially vertical machine axis.

It has also been assumed above that the transfer elements 4 or 4*a* are each multi-layered, produced from the adhesive layer 5, the intermediate layer 6 and the carrier layer 7. However, among other things, it is also possible to produce several layers in one piece, for example the adhesive layer 5 can be produced as a closed outer skin or layer of a resilient intermediate layer 6 that is realized with a plurality of pores. Through the resilient, cushion-like design of the transfer element 4, it may be possible to compensate for the bottle or container tolerances in the transfer element.

If, in the disclosure or claims of the present application, the information-adding station is described as being utilized "in combination with" or "with" a bottle filling plant or a container filling plant, it is not necessary that the information-adding machine is disposed within a bottle filling plant or container filling plant. In at least one possible embodiment of the present application, for example, bottles or containers may be filled in a bottle or container filling plant. The bottles or containers may then be shipped to a facility wherein the information-adding station may apply information to the bottles according to the present application. In at least one possible embodiment, bottles may first have information added to their outer surfaces via an information-adding station according to the present application. In this embodiment, the bottles may then be shipped to a bottling plant where the bottles are filled and closed. In at least one possible embodiment of the present application, the information-adding machine may be disposed in a bottling plant and be connected to or utilized directly in conjunction with a bottling plant and/or bottling system.

The present application relates to an apparatus for printing bottles or similar containers on an outer surface of a container. The apparatus comprises at least one printing station. The containers may be moved past the print region of the printing station on a container conveyor, at least one print head, and a transfer element. The transfer element forms at least one transfer surface, which is provided at an auxiliary conveyor and is moved by way of the auxiliary conveyor at least between the at least one print head and the print region for applying a negative print image onto the at least one transfer surface for transferring the negative print image onto a container region rolling off the transfer surface.

Apparatus for printing bottles or similar containers on an outer surface of a container, the apparatus having at least one printing station, the containers being moved past the print region of said printing station on a container conveyor, and at least one print head and a transfer element, which forms at least one transfer surface and is provided at an auxiliary conveyor.

One feature or aspect of an embodiment is believed at the time of the filing of this patent application to possibly reside broadly in an apparatus for printing bottles or similar containers 2 on an outer surface of a container, said apparatus having at least one printing station 1, 1*a*, the containers 2 being moved past the print region 11, 11*a* of said printing station on a container conveyor 12, 21, and at least one print head 8 and a transfer element 4, 4*a*, which forms at least one transfer surface 4.1, 4.1*a*, is provided at an auxiliary conveyor 3, 19 and is moved by way of the auxiliary conveyor 3, 19 at least between the at least one print head 8 and the print region 11, 11*a* for applying a negative print image onto the at least one transfer surface 4.1, 4*a*.1 for transferring the negative print image onto a container region 2.1, 2.2 rolling off the transfer surface 4.1, 4*a*.1, wherein the transfer surface 41, 4*a*.1 is resilient or springy.

Another feature or aspect of an embodiment is believed at the time of the filing of this patent application to possibly reside broadly in the apparatus, wherein in each case a complete negative print image is created by way of the print head 8.

Yet another feature or aspect of an embodiment is believed at the time of the filing of this patent application to possibly reside broadly in the apparatus, wherein at least one station 10 is provided for cleaning the at least one transfer surface 4.1, 4*a*.1 in the direction of movement or direction of transport A, D of the auxiliary conveyor 3, 19 upstream of the at least one print head 8.

Still another feature or aspect of an embodiment is believed at the time of the filing of this patent application to possibly reside broadly in the apparatus, wherein a plurality of transfer elements 4, 4*a* are provided at the auxiliary conveyor 3, 19.

A further feature or aspect of an embodiment is believed at the time of the filing of this patent application to possibly reside broadly in the apparatus, wherein each transfer element 4, 4*a* is realized with at least two layers, comprising an adhesive layer forming the transfer surface 4.1, 4*a*.1 and a resilient intermediate layer 6 supporting said adhesive layer.

Another feature or aspect of an embodiment is believed at the time of the filing of this patent application to possibly reside broadly in the apparatus, wherein the adhesive layer 5 and/or the intermediate layer 6 is produced from one or more individual layers or coats.

Yet another feature or aspect of an embodiment is believed at the time of the filing of this patent application to possibly reside broadly in the apparatus, wherein the auxiliary conveyor is a transfer drum 3 driven in a rotating manner about a drum axis, for example about an axis parallel or substantially parallel to the axis of the containers 2.

Still another feature or aspect of an embodiment is believed at the time of the filing of this patent application to possibly reside broadly in the apparatus, wherein the auxiliary transporter is formed by at least one band-like, belt-like or chain-like transport element 19 forming a closed loop.

A further feature or aspect of an embodiment is believed at the time of the filing of this patent application to possibly reside broadly in the apparatus, wherein the container conveyor 12 is a turntable or rotor that rotates about a vertical or substantially vertical machine axis.

Another feature or aspect of an embodiment is believed at the time of the filing of this patent application to possibly reside broadly in the apparatus, wherein the container conveyor 21 is a linear conveyor.

Yet another feature or aspect of an embodiment is believed at the time of the filing of this patent application to possibly reside broadly in the apparatus, comprising container carriers 13, 22 at the container conveyor 12, 21 for one container 2 in each case.

Still another feature or aspect of an embodiment is believed at the time of the filing of this patent application to possibly reside broadly in the apparatus, comprising means for the controlled rotating of the container carriers 13, 22 and consequently of the containers 2 at least at the print region 11, 11*a*.

A further feature or aspect of an embodiment is believed at the time of the filing of this patent application to possibly reside broadly in the apparatus, comprising means for the controlled moving of the container carriers 13 in the manner that the path of movement of the container carriers 13 and consequently of the containers 2 located on said container carriers extends at the print region 11 of the at least one print station 1 parallel or substantially parallel to the path of movement at that location of the transfer elements 4, for example concentrically to a circular path of movement of the transfer elements 4.

One feature or aspect of an embodiment is believed at the time of the filing of this patent application to possibly reside broadly in the apparatus, wherein the at least one transfer surface 4.1 of the at least one transfer element 4 is curved in a convex manner, for example in an arcuate manner.

Another feature or aspect of an embodiment is believed at the time of the filing of this patent application to possibly reside broadly in the apparatus, wherein the at least one transfer surface 4*a*.1 of the at least one transfer element 4*a* is planar or substantially planar.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

U.S. patent application Ser. No. 12/370,667, filed on Feb. 13, 2007, having inventor Volker TILL, and title "METHOD AND APPARATUS FOR THE CIRCUMFERENTIAL PRINTING ONTO INDIVIDUAL BOTTLES IN A RUN OF BOTTLES WHERE THE INDIVIDUAL BOTTLES IN THE RUN HAVE AT LEAST ONE VARYING DIMENSION DUE TO MANUFACTURING TOLERANCES, THE METHOD AND APPARATUS PROVIDING MORE CONSISTENT ARTWORK ON INDIVIDUAL CONTAINERS IN THE RUN OF CONTAINERS," and its corresponding Federal Republic of Germany Patent Application No. DE 10 2006 038 247.1, filed on Aug. 16, 2006, and International Patent Application No. PCT/EP2007/007189, filed on Aug. 15, 2007, having WIPO Publication No. WO2008/019829 A1, and inventor Volker TILL, and its corresponding Federal Republic of Germany Patent Application No. DE 10 2006 038 249.8, filed on Aug. 16, 2006, and International Patent Application No. PCT/EP2007/007190, filed on Aug. 15, 2007, having WIPO Publication No. WO2008/019830, and inventor Volker TILL are hereby incorporated by reference as if set forth in their entirety herein.

U.S. patent application Ser. No. 12/257,935, filed on Oct. 24, 2008, having inventor Volker TILL, and title "METHOD AND DEVICE FOR PRINTING IMAGES AND/OR TEXT ON PACKAGING MATERIAL AND THEN FORMING PACKAGES FOR CONTAINING LIQUID BEVERAGE OR OTHER MATERIALS OUT OF THE PRINTED PACKAGING MATERIAL," and its corresponding Federal Republic of Germany Patent Application No. DE 10 2006 019 994.4, filed on Apr. 26, 2006, and International Patent Application No. PCT/EP2007/003680, filed on Apr. 26, 2007, having WIPO Publication No. WO2007/124913 A1, and inventor Volker TILL are hereby incorporated by reference as if set forth in their entirety herein.

The "Tonejet" print head, developed by The Technology Partnership plc, is an example of a print head which may possibly be utilized or adapted for use in at least one possible embodiment. Some examples of print heads that may possibly be utilized or adapted for use in at least one possible embodiment may possibly be found in the following U.S. patents: U.S. Pat. No. 7,387,366, issued Jun. 17, 2008, entitled "Printhead;" U.S. Pat. No. 6,820,965, issued Nov. 23, 2004, entitled "Drop-on-Demand Printer;" U.S. Pat. No. 7,407,271, issued Aug. 5, 2008, entitled "Self-Cooling Thermal Ink Jet Printhead;" and U.S. Pat. No. 7,380,906, issued Jun. 3, 2008, entitled "Printhead."

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

Some examples of apparatus and methods for the drying and/or hardening of ink that may possibly be utilized or adapted for use in at least one possible embodiment may possibly be found in the following U.S. patents: U.S. Pat. No. 6,493,018, entitled "Wide format thermal printer;" U.S. Pat. No. 6,957,030, entitled "Method and apparatus for making signs;" U.S. Pat. No. 4,970,528, entitled "Method for uniformly drying ink on paper from an ink jet printer;" U.S. Pat. No. 6,312,123, entitled "Method and apparatus for UV ink jet printing on fabric and combination printing and quilting thereby;" and U.S. Pat. No. 6,857,737, entitled "UV ink printed graphic article."

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

U.S. patent application Ser. No. 12/202,610, filed on Sep. 2, 2008, having inventor Volker TILL, and title "METHOD OF OPERATING A MULTIPLE CONTAINER SHRINK WRAPPING MACHINE HAVING A PRINTING ARRANGEMENT TO PRINT OF THE SHRINK WRAP MATERIAL SIMULTANEOUSLY WHILE WRAPPING CONTAINERS AND A MULTIPLE CONTAINER SHRINK WRAPPING MACHINE THEREFOR," and its corresponding Federal Republic of Germany Patent Application No. DE 10 2006 009 348.8, filed on Mar. 1, 2006, and International Patent Application No. PCT/EP2007/000888, filed on Feb. 2, 2007, having WIPO Publication No. WO2007/101517 A2, and inventor Volker TILL are hereby incorporated by reference as if set forth in their entirety herein.

U.S. patent application Ser. No. 12/255,876 filed on Oct. 22, 2008, having inventor Volker TILL, and title "METHOD AND DEVICE FOR LABELING CONTAINERS," and its corresponding Federal Republic of Germany Patent Application No. DE 10 2006 019 441.1, filed on Apr. 24, 2006, and International Patent Application No. PCT/EP2007/002999, filed on Apr. 3, 2007, having WIPO Publication No. WO2007/121835 and inventor Volker TILL, are hereby incorporated by reference as if set forth in their entirety herein.

U.S. patent application Ser. No. 12/355,870, filed on Jan. 19, 2009, having inventor Volker TILL, and title "METHOD AND APPARATUS FOR THE CIRCUMFERENTIAL LABELING OF A RUN OF BLOW MOLDED BOTTLES WHERE THE INDIVIDUAL BOTTLES IN THE RUN HAVE AT LEAST ONE VARYING DIMENSION DUE TO MANUFACTURING TOLERANCES, THE METHOD AND APPARATUS PROVIDING MORE CONSISTENT LABELING OF INDIVIDUAL CONTAINERS IN THE RUN OF CONTAINERS," and its corresponding Federal Republic of Germany Patent Application No. DE 10 2006 038 249.8, filed on Aug. 16, 2006, and International Patent Application No. PCT/EP2007/007190, filed on Aug. 15, 2007, having WIPO Publication No. WO2008/019830 A1, and inventor Volker TILL are hereby incorporated by reference as if set forth in their entirety herein.

U.S. patent application Ser. No. 12/690,645, filed on Jan. 20, 2010, having inventor Frank PUTZER, and title "BEVERAGE BOTTLING PLANT HAVING AN INFORMATION ADDING STATION FOR ADDING INFORMATION TO BOTTLES AND A METHOD OF OPERATING A BEVERAGE BOTTLING PLANT INFORMATION ADDING STATION," is hereby incorporated by reference as if set forth in their entirety herein.

The following patents, patent applications or patent publications, are hereby incorporated by reference as if set forth in their entirety herein except for the exceptions indicated herein: GB 2 376 920, having the title "Inkjet printing on a three-dimensional object including relative movement of a printhead and the object during printing about a rotational axis," published on Dec. 31, 2002; WO2004/009360, having the title "PRINTING PROCESS AND APPARATUS," published on Jan. 29, 2004; U.S. Pat. No. 6,684,770, having the title "Apparatus and method for direct rotary printing compositions only cylindrical articles," published on Jul. 3, 2003; U.S. Pat. No. 7,011,728, having the title "Container-labeling and -printing synchronization apparatus and process," published on Mar. 14, 2006; and U.S. Pat. No. 6,920,822, having the title "Digital can decorating apparatus," published on Jul. 26, 2005.

All of the patents, patent applications or patent publications, which were cited in the International Search Report dated Jan. 7, 2009, and/or cited elsewhere are hereby incorporated by reference as if set forth in their entirety herein as follows, except for the exceptions indicated herein: WO 2008/031930, having the title "DEVICE FOR PRINTING BY TRANSFER ONTO A CYLINDRICAL PRINT SUPPORT," published on Mar. 20, 2008; WO 03/103966, having the title "PROCESS AND DEVICE FOR PRINTING A MULTICOLOR IMAGE," published on Dec. 18, 2003; EP 1 053 882, having the title "Improved multicolor pad printing system," published on Nov. 22, 2000; and U.S. Pat. No. 6,769,357, having the title "Digital can decorating apparatus," published on Aug. 3, 2004.

The patents, patent applications, and patent publications listed above in the preceding paragraphs are herein incorporated by reference as if set forth in their entirety except for the exceptions indicated herein. The purpose of incorporating U.S. patents, Foreign patents, publications, etc. is solely to provide additional information relating to technical features of one or more embodiments, which information may not be completely disclosed in the wording in the pages of this application. However, words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments of the patents, patent applications, and patent publications, are not considered to be incorporated by reference herein.

The corresponding foreign and international patent publication applications, namely, Federal Republic of Germany Patent Application No. 10 2007 050 493.6, filed on Oct. 19, 2007, having inventor Martin SCHACH, and DE-OS 10 2007 050 493.6 and DE-PS 10 2007 050 493.6, Federal Republic of Germany Patent Application No. 10 2007 050 490.1, filed on Oct. 19, 2007, having inventor Martin SCHACH, and DE-OS 10 2007 050 490.1 and DE-PS 10 2007 050 490.1, and International Application No. PCT/EP2008/007043, filed on Aug. 28, 2008, having WIPO Publication No. WO 2009/052890 and inventor Martin SCHACH, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein except for the exceptions indicated herein.

The purpose of incorporating the corresponding foreign equivalent patent application(s), that is, PCT/EP2008/007043, German Patent Application 10 2007 050 493.6, and German Patent Application 10 2007 050 490.1, is solely for the purpose of providing a basis of correction of any wording in the pages of the present application, which may have been mistranslated or misinterpreted by the translator. However, words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments of the patents, patent applications, and patent publications, are not generally considered to be incorporated by reference herein.

Statements made in the original foreign patent applications PCT/EP2008/007043, DE 10 2007 050 493.6, and DE 10 2007 050 490.1 from which this patent application claims priority which do not have to do with the correction of the translation in this patent application are not to be included in this patent application in the incorporation by reference.

Any statements about admissions of prior art in the original foreign patent applications PCT/EP2008/007043, DE 10 2007 050 493.6, and DE 10 2007 050 490.1 are not to be included in this patent application in the incorporation by reference, since the laws relating to prior art in non-U.S. Patent Offices and courts may be substantially different from the Patent Laws of the United States.

All of the references and documents, cited in any of the documents cited herein, are hereby incorporated by reference as if set forth in their entirety herein exception for the exceptions indicated herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1, 1*a* Printing station
2 Bottle
2.1 Bottle belly
2.2 Bottle neck
3 Transfer drum
4, 4*a* Transfer element
4.1, 4*a*.1 Transfer surface
5 Adhesive layer
6 Intermediate layer
7 Support element
8 Print head
9 Control device
10 Cleaning station
11, 11*a* Printing position or printing region
12 Container conveyor
13 Container carrier
14 Drying station
15 Apparatus
16 Conveyor belt
17 Inlet star
18 Outlet star
19 Auxiliary conveyor or loop-shaped transport element
19.1, 19.2 Rectilinear length of the loop of the transport element 19
20 Wheel
21 Container conveyor
22 Container carrier
A Direction of rotation of the transfer drum 3
B Direction of rotation or of transport of the container conveyor 12
C Direction of rotation of the container carrier 13
D Direction of movement of the transport element 19
E Direction of transport of the container conveyor 21
F Direction of rotation of the container carrier 22

What is claimed is:

1. A method of printing bottles or similar containers on an outer surface thereof using a container printing arrangement, said method comprising:

moving containers on rotatable container supports of a container conveyor past at least one printing station, said at least one printing station comprising: at least one print head, a conveyor arrangement, and transfer elements;

moving, with said conveyor arrangement, said transfer elements from said at least one print head to a printing region, which transfer elements each comprise a first resilient layer and a second resilient layer which supports said first resilient layer;

receiving, from said at least one print head, a print image onto a transfer surface of said first resilient layer;

moving said container conveyor synchronously with said conveyor arrangement, at least in the printing region, and thereby moving each container into contact with a corresponding one of said transfer elements throughout the transfer of a print image onto each container; and rotating each of said container supports, and thus each container supported thereby, to roll each container on and with said transfer surface, essentially without slip, and thereby transferring a complete print image onto and about an outer surface of the container.

2. The method according to claim 1, wherein said method further comprises moving container carriers of said container conveyor along a path of movement which follows or substantially follows a portion of the path of movement of said transfer elements on said conveyor arrangement.

3. The method according to claim 2, wherein said first resilient layer and/or said second resilient layer comprises one or more individual layers.

4. The method according to claim 3, wherein said method further comprises compensating, using said second resilient layer, for dimensional tolerances in the diameters or shape of the containers.

5. The method according to claim 4, wherein said step of moving said container carriers along a path of movement comprises moving said container carriers around a curved or arcuate path which follows or substantially follows a portion of a curved or arcuate path of movement of said transfer elements on said conveyor arrangement.

6. The method according to claim 5, wherein said step of moving said container carriers along a path of movement comprises moving said container carriers along a linear path which follows or substantially follows a portion of a linear path of movement of said transfer elements on said conveyor arrangement.

7. The method according to claim 1, wherein said method further comprises compensating, using said second resilient layer, for dimensional tolerances of as much as 0.5 millimeter to 0.7 millimeter in the diameters of the containers, or for unevenness in the outer surface of the containers.

8. A container printing arrangement for printing bottles or similar containers on an outer surface thereof, said container printing arrangement comprising:

at least one printing station;

a container conveyor configured to move containers past said at least one printing station;

said at least one printing station comprising: at least one print head, a conveyor arrangement, and transfer elements;

said conveyor arrangement is configured to move said transfer elements from said at least one print head to a printing region;

said transfer elements each comprise a first resilient layer and a second resilient layer which supports said first resilient layer;

said first resilient layer comprises a transfer surface configured to receive a print image from said at least one print head, and to transfer a print image onto a container;

said container conveyor comprising rotatable container supports;

said container conveyor being configured to move synchronously with said conveyor arrangement, at least in the printing region, so as to move each container into contact with a corresponding one of said transfer elements throughout the transfer of a print image onto each container; and each of said container supports being configured to rotate each container supported thereby to roll each container on and with the transfer surface, essentially without slip, and thereby permit the transfer of a complete print image onto and about an outer surface of each container.

9. The container printing arrangement according to claim 8, wherein said first resilient layer and/or said second resilient layer comprises one or more individual layers.

10. The container printing arrangement according to claim 9, said container conveyor is configured to move said container carriers along a path of movement which follows or substantially follows a portion of the path of movement of said transfer elements on said conveyor arrangement.

11. The container printing arrangement according to claim 10, wherein each of said at least one print head is configured to print a complete negative print image.

12. The container printing arrangement according to claim 11, wherein the container printing arrangement comprises at least one cleaning station configured to clean said transfer surfaces, which at least one cleaning station is disposed upstream of said at least one print head in the direction of movement or direction of transport of said conveyor arrangement.

13. The container printing arrangement according to claim 12, wherein said container conveyor is a linear conveyor, or is a rotary conveyor configured to rotate about a vertical machine axis.

14. The container printing arrangement according to claim 13, wherein said conveyor arrangement comprises a transfer drum configured to be rotated about a drum axis configured to be disposed parallel or substantially parallel to the axis of containers to be printed, and said transfer surface is curved in a convex or arcuate manner.

15. The container printing arrangement according to claim 13, wherein said conveyor arrangement comprises at least one band-like, belt-like or chain-like transport element forming a closed loop, and said transfer surface is planar or substantially planar.

16. The container printing arrangement according to claim 8, wherein:

each of said first resilient layer and said second resilient layer having a length, width, and thickness, which thickness is substantially constant over the length and the width and is substantially less than the length and the width;

each of said first resilient layer and said second resilient layer comprises a first surface defined by the length and the width, and a second surface defined by the length and the width, wherein said first surface is disposed to face away from said second surface; and said second resilient layer is disposed to support said first resilient layer thereon, such that a substantial portion of said second surface of said first resilient layer is in contact with a substantial portion of said first surface of said second resilient layer.

17. The container printing arrangement according to claim 8, wherein said first resilient layer comprises a different material than said second resilient layer.

18. The container printing arrangement according to claim 17, wherein each of said transfer elements comprises a third layer which connects said second layer to said conveyor arrangement, which third layer comprises a different material than said first and second layers.

19. The container printing arrangement according to claim 8, wherein said second resilient layer is sufficiently resilient to compensate for dimensional tolerances of as much as 0.5 millimeter to 0.7 millimeter in the diameters of containers to be printed on, or to compensate for unevenness in the outer surface of containers to be printed on.

* * * * *